US005993243A

United States Patent [19]

Daoud

[11] Patent Number: 5,993,243

[45] Date of Patent: Nov. 30, 1999

[54] NETWORK INTERFACE DEVICE

[75] Inventor: Bassel H. Daoud, Parsippany, N.J.

[73] Assignee: Lucent Technologies, Inc., Murray Hill, N.J.

[21] Appl. No.: 09/107,953

[22] Filed: Jun. 30, 1998

[51] Int. Cl.[6] ..... H01R 4/24

[52] U.S. Cl. ..... 439/409

[58] Field of Search ..... 439/409, 410, 439/417, 652, 502

[56] References Cited

U.S. PATENT DOCUMENTS

| | | | |
|---|---|---|---|
| 4,396,809 | 8/1983 | Brunssen | 179/175 |
| 4,874,329 | 10/1989 | Yu | 439/409 |
| 4,913,659 | 4/1990 | Doyle | 439/395 |
| 4,965,877 | 10/1990 | Gunn | 439/502 |
| 5,004,433 | 4/1991 | Daoud | 439/502 |
| 5,222,908 | 6/1993 | Baker, III et al. | 439/557 |
| 5,240,432 | 8/1993 | Daoud | 439/417 |
| 5,562,478 | 10/1996 | Yamamoto | 439/417 |
| 5,721,396 | 2/1998 | Daoud | 174/59 |
| 5,740,685 | 4/1998 | Daoud | 70/164 |

OTHER PUBLICATIONS

Egerton, Advertisement entitled "Mini–Rocker Cross Connect".

*Primary Examiner*—Neil Abrams
*Assistant Examiner*—Java Nasri
*Attorney, Agent, or Firm*—Duane Morris & Heckscher LLP; Steven E. Koffs

[57] ABSTRACT

An insulation displacement connector has a pivotably attached cap with a centrally positioned latch positioned between the lead wire receiving holes of the connector. The connector has two terminals. Each terminal has an upper portion including a pair of upwardly projecting members. The terminals each have a lower portion connectable to respective first and second plug wires. The connector has a housing. The housing has a lower portion. The lower portion has first and second openings in which the terminals are seated. An upper portion is pivotably attached to the lower portion of the housing. The upper portion of the housing includes two lead wire receiving holes. The upper portion of the housing has an open position for insertion of lead wires in the holes, and a closed position for connecting the upwardly projecting members of the first and second terminals to the respective lead wires. A single latch is positioned between the first and second holes, for maintaining the upper portion of the housing in the closed position. The connector may be included in a bridge assembly. The connector is mounted on a base. The base has an RJ11 jack capable of receiving an RJ11 plug. The RJ11 plug is connected to respective ends of the plug wires opposite the terminals. The base has a type-645 jack for receiving a type-645 plug which is connected to an external network. The type-645 jack is positioned so that the RJ11 plug is electrically connected to the type-645 plug when the RJ11 plug is inserted in the RJ11 jack and the 645 plug is inserted in the 645 jack.

16 Claims, 2 Drawing Sheets

120
119
125
126
127
128
129
121
122
123
123a
123b
123c
123d
123e
123f
124
172
112
113
114
118
196
198
Z
Y
X

NETWORK INTERFACE DEVICE

FIELD OF THE INVENTION

The present invention relates to network interfaces for telecommunications equipment.

DESCRIPTION OF THE RELATED ART

Most modern multi-occupant buildings have a network interface unit, which includes a plurality of customer bridges. Each customer bridge provides an interface between the external telephone network lines and the internal lines of an individual customer. An example of a bridge assembly is described in U.S. Pat. No. 5,222,908 to Baker, III et al., which is incorporated by reference herein in its entirety.

The bridge typically includes a standard RJ11 jack which provides a test point for testing continuity at the entrance to the customer premises. A standard telephone may be plugged into the RJ11 jack for test purposes; if a normal dial tone is provided, then there is continuity in the circuits outside of the customer's premises. In normal operation, however, the jack is attached to an output wire connector through an RJ11 plug/cord assembly such as the assemblies described in U.S Pat. Nos. 5,004,433 and 5,240,432 to Daoud, both of which are also incorporated by reference herein in their entireties. The customer's telephones, PBX equipment, etc. all are in turn connected through the output wire connector.

A customer bridge system is desired which can be installed more quickly.

SUMMARY OF THE INVENTION

The present invention is an insulation displacement connector having a pivotably attached cap with a centrally positioned latch positioned between the lead wire receiving holes of the connector.

According to a further aspect of the invention, the connector has first and second terminals. Each terminal has an upper portion including a pair of upwardly projecting members. The terminals each have a lower portion connectable to respective first and second wires. The connector has a housing. The housing has a lower portion. The lower portion has first and second openings in which the respective first and second terminals are seated. An upper portion is pivotably attached to the lower portion of the housing. The upper portion of the housing includes first and second holes. The upper portion of the housing has an open position for insertion of respective third and fourth wires in the first and second holes, respectively, and a closed position for connecting the upwardly projecting members of the first and second terminals to the third and fourth wires, respectively. A single latch is positioned between the first and second holes, for maintaining the upper portion of the housing in the closed position.

According to still further aspects of the invention, the connector is included in a bridge assembly. The connector is mounted on a base. The base has a jack. The jack is capable of receiving a plug for forming an electrical connection. The plug is connected to respective ends of the first and second wires opposite the first and second terminals. The base has an additional jack for receiving an additional plug which is connected to an external network. The additional jack is positioned so that the plug is electrically connected to the additional plug when the plug is inserted in the jack and the additional plug is inserted in the additional jack. The base has an opening. The opening has a first portion extending downward from a top of the base, and a second portion extending upward from a bottom of the base. The first and second portions are offset from each other, so that the opening provides stress relief when the first and second wires are positioned in the opening.

DETAILED DESCRIPTION

Figure 1:
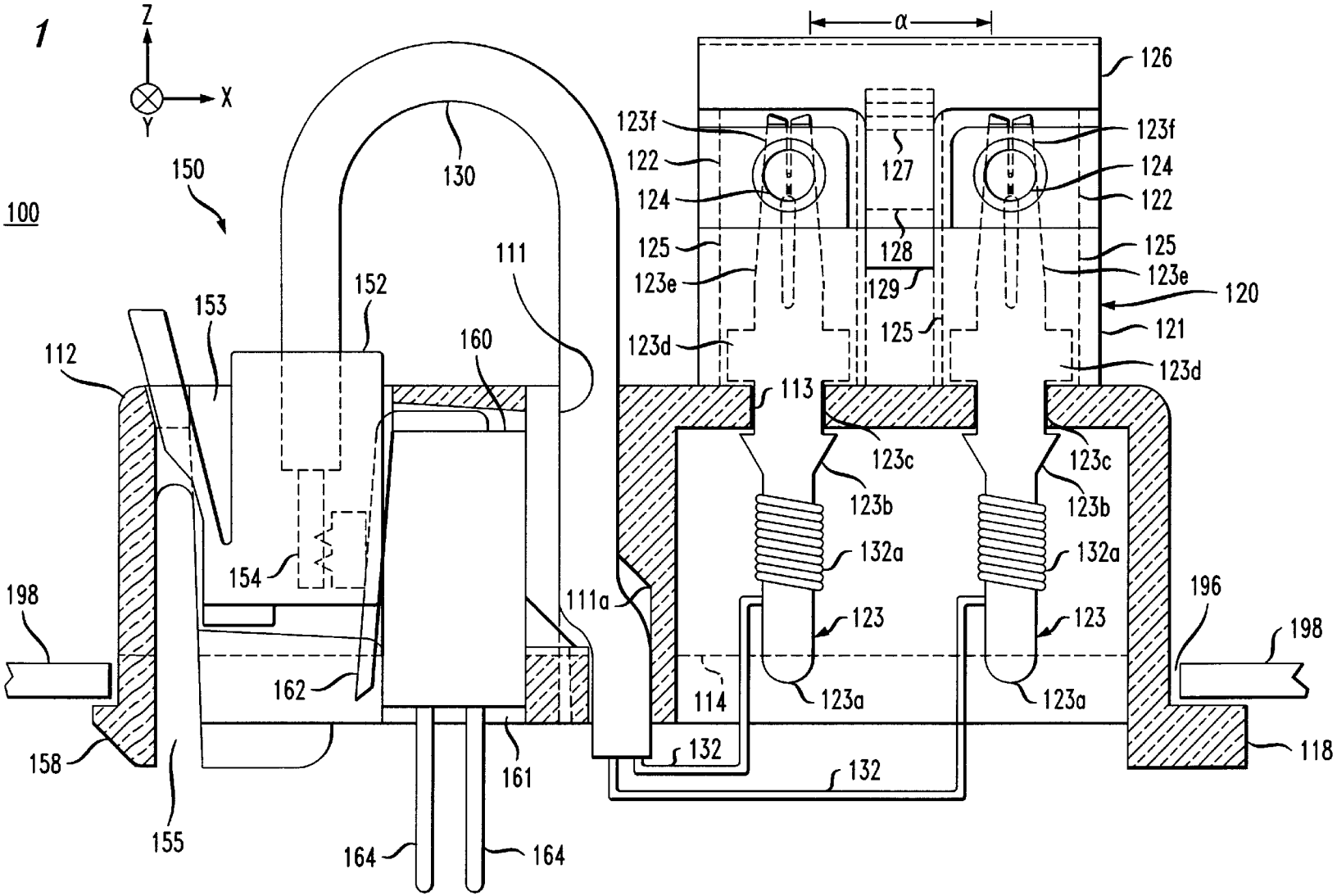
FIG. 1 is a front cross sectional view of an exemplary bridge assembly according to the present invention.

The present invention is an insulation displacement connector (IDC) 120 for a customer bridge assembly 100, and a bridge assembly which includes the connector. The connector 120 is maintained in a closed position by a latch 129 positioned between the wire receiving holes 124 of the IDC connector 120. This positioning of the latch 129 provides several unexpected advantages, which are described in detail below. The cap 126 of the connector 120 is pivotably mounted to the lower portion 121 of the housing 119 of the connector 120.

Further, the connector 120 is attached to the base 112 of the bridge assembly 100, and the entire bridge assembly is connected to a single base unit 112, providing further advantages over bridge assemblies of the prior art. These an other aspects of the invention are described below with reference to an exemplary embodiment of the invention.

FIG. 1 is a cross-sectional view of an exemplary bridge assembly 100. The assembly 100 has a base 112 on which the connector 120 is mounted. The exemplary base 112 has a pair of jacks. The first jack 161 connects the bridge to an external telephone network. The jack 161 is capable of receiving a plug 160 for forming an electrical connection to the network. For example, the network lines 164 coming from a central office may terminate in a type-645 plug 160. In a residential building, the plug 160 is typically located near the point where the wires 164 enter the building. In a multi-tenant building, the plug 160 is typically located in a network interface unit which houses a respective plug 160 for each subscriber.

The second jack 153 is preferably a standard jack for a telephone device, which may be an RJ11 jack. In the exemplary embodiment, there is no wall separating 645 -type jack 161 from RJ11 jack 153. When an RJ11 plug 152 is inserted into jack 153, and a 645 plug 160 is inserted into type-645 jack 161, the terminals 162 of the type-645 jack 160 engage the conductor 154 of the RJ11 plug 152, thus establishing an electrical connection between the external telephone network and RJ11 plug 152. The combined footprint of the 645-type plug 160 and the RJ11 plug 152 is about 1.25 centimeters (0.5 inches).

One of ordinary skill recognizes that an intermediate portion of conductive material (not shown) could be placed between the 645-type plug 160 and the RJ11 plug 152 without substantially changing the function or operation of the assembly. However, this would add weight to the assembly, and increase its footprint.

RJ11 plug 152 is connected to a cable 130 having standard tip and ring wires 132. Cable 130 provides a simple means to connect the customer connector 120 with NID 150. During normal operation, RJ11 plug 152 is inserted into RJ11 jack 153. Plug 152 may be removed, in order to test the network connection (i.e., by inserting the plug of a standard telephone device into jack 153). Similarly, plug 152 may be removed any time that it is necessary to perform work on the customer connector 120. This protects a human handling the wires in the customer connector 120, in the event of an abnormal high-voltage condition, which may occur if above ground telephone wires are struck by lightening.

NID 150 is separated from the customer connector assembly 120 by a recess 111 in housing 112. Recess 111 has a portion extending from the top of base 112 and a portion extending from the bottom of base 112. The top and bottom portions of recess 111 are offset from one and other. When cable 130 is inserted into recess 111, the offset 111*a* grips the cable 130 and prevents slippage of the cable. The recess 111 extends from one face only, namely the front face of the assembly 100 as shown. The back face of housing 112 extends continuously along the length of housing 112. The use of an offset configuration 111*a* for stress relief is described in greater detail in U.S. Pat. No. 5,004,433 to Daoud, which is incorporated by reference herein in its entirety.

The bridge assembly 100 may be mounted in a conventional network interface panel 198. A typical sheet metal panel 198 has a plurality of standard sized rectangular openings 196. The two ends 118 and 155 of the base 112 form a latch mechanism, by which the bridge assembly is mounted in an opening 196 of panel 198. A bearing surface 114 engages the sheet metal surface of the panel 198 around the opening and prevents the assembly 100 from falling out the back of the panel. If the RJ11 plug 152, cable 130 and wire wraps 132*a* are pre-assembled, then the installation procedure for the bridge assembly may be as simple as: (1) snapping the assembly 100 into the opening 196 by latch 158, (2) unplugging the RJ11 jack 152 (if plugged in), (3) inserting the 645-type plug 160 into jack 161, (4) inserting customer lead wires (not shown) into holes 124, (5) snapping the cap 126 of connector 120 into the closed position of FIG. 2A, and (6) inserting the RJ11 plug 152 into the RJ11 jack 152.

According to a further aspect of the invention, the NID 150 is housed on the same base 112 as the IDC connector 120. Thus, the entire bridge assembly 100, including the base 112, RJ11 plug 152, cable 130 and connector 120 (with wire wraps 132*a* on terminals 123) may be pre-assembled and packaged for a quick installation. Further, the assembly 100 occupies a smaller footprint than known customer bridges.

Connector 120 is now described in detail. Connector 120 has two main components: a housing 119 and a pair of terminals 123. The housing 119 has two main portions: a lower portion 121 and an upper portion (or cap) 126.

Lower portion 121 has first and second openings 125 in which the respective first and second terminals 123 are seated. Lower portion 121 may be integrally formed from the same piece of material as base 112, as shown. Alternatively, lower portion 121 may be formed from a separate piece of material and fastened to base 112 using a conventional technique, such as a mechanical fastener (e.g., a latch, not shown) or an adhesive, which may be an epoxy.

As is well known in conventional insulation displacement connectors, each of the terminals 123 may include a bottom portion 123*a* suitable for a wire-wrap connection 132*a* to wires 132. Exemplary terminal 123 is fixedly mounted into base 112, with a connecting portion 123*c* fitting in slot 113, and the base 112 firmly grasped between a barb 123*b* and a shoulder 123d of the terminal 123. One of ordinary skill in the art recognizes that in normal use, most of the forces applied on the terminals 123 is in the downward direction, and very little upward force is applied. Therefore, shoulder 123*d* is typically larger (and therefore stronger) than the barb 123*b*. A top portion 123*e* of terminal 123 has means for displacing sufficient insulation from a lead wire to form an electrical connection therewith. In the exemplary terminal 123, the insulation displacing means may be a pair of upwardly extending tangs 123*f* for receiving the customer lead wires (not shown), and stripping insulation from the lead wires. Other equivalent insulation displacing means may be used.

The exemplary upper portion (cap) 126 of housing 119 is pivotably attached to the lower portion 121 of the housing. The upper portion 126 of the housing 119 has two slots 122 which fit over the terminals 123 when the upper portion is pivoted to the positions shown in FIGS. 2A and 2B. The slots 122 are aligned with the slots 125 of the lower portion of the housing 119. The slots 122 may be slightly larger at the bottom than at the top, so that the bottom of the slot 122 can clear the tangs of terminals 123*f* throughout the range of motion of upper portion 126.

The upper portion 126 includes first and second lead wire receiving holes 124. The upper portion 126 of the housing 119 has an open position (FIG. 2B) for insertion of respective lead wires (not shown) in the holes 124. The upper portion 126 of housing 119 also has a closed position (FIG. 2A) for connecting the upwardly projecting members 123*f* of the terminals 123 to the lead wires. Cap 126 has a latch 129 which may be engaged by either one of projections 128 (FIG. 2A, closed position) or 127 (FIG. 2B, open position).

Cap 126 pivots about the pivoting joint 172. One of ordinary skill in the art recognizes that the lower portion 121 and upper portion 126 of housing 119 may be formed from a single piece of material, in which case the pivoting joint 172 may be a living hinge. The material which may be, for example, an insulating plastic material, such as polypropylene or polycarbonate. In particular, if the living hinge 172 is used, it is possible to use a single piece of material such as polypropylene.

Alternatively, the upper portion 126 and lower portion 121 may be formed from separate pieces of material, in which case any conventional pivot joint may be used. One of ordinary skill further recognizes that the upper and lower portions of housing 119 need not be attached by a pivoting joint. Latches may be used alone, but that would increase the chance that the upper portion 126 becomes lost when separated from the lower portion 121.

Figures 2A, 2B, 2C:
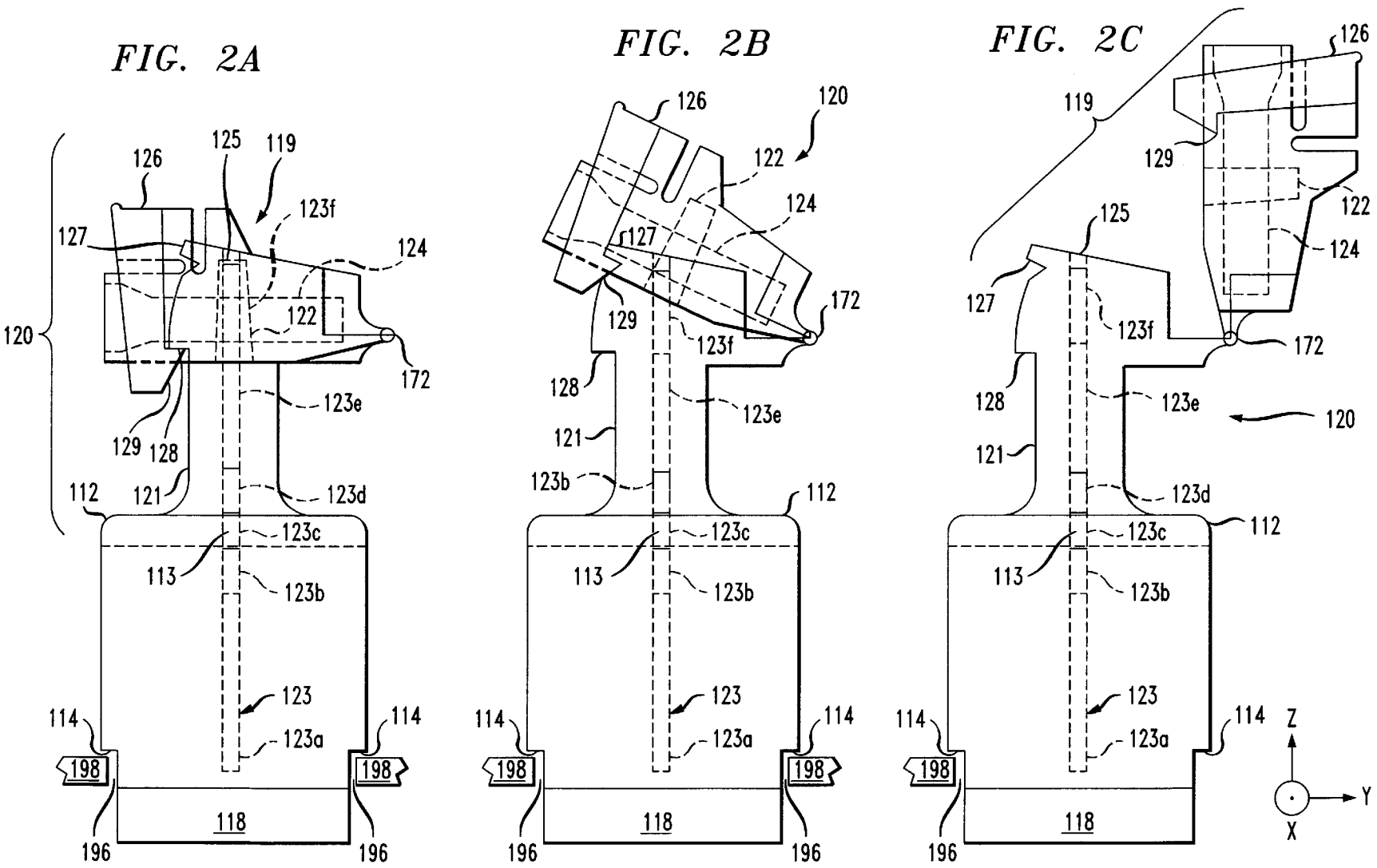
FIG. 2A is a side elevation view of the bridge assembly of FIG. 1, with the connector in the closed position.
FIG. 2B is a side elevation view of the bridge assembly of FIG. 1, with the connector in the open position.
FIG. 2C is a side elevation view of the bridge assembly of FIG. 1, with the connector cap removed for insertion of terminals.

FIG. 2C shows the connector 120 with the cap 126 pivoted completely off of the lower portion 121 of connector 120, for installing the terminals 123. With the cap 126 in the position shown in FIG. 2C, terminals 123 are easily inserted into slots 125, as shown. Using a relatively small barb 123*b*, as shown, the terminals may be pressed into the slots 113, without using any adhesives.

Once assembled, connector 120 is normally positioned with latch 129 engaging either projection 127 in the open position (FIG. 2B) or projection 129 in the closed position (FIG. 2A). With connector 120 in the open position (FIG. 2B), customer lead wires may be inserted into lead wire receiving holes 124. By pressing down on cap 126, the user causes cap 126 to pivot about living hinge 172, forcing the customer lead wires down into the tangs of terminals 123. By the time cap 126 reaches the closed position shown in FIG. 2A, sufficient insulation is displaced from the customer lead wires to establish an electrical connection between the customer lead wires and terminals 123.

Moreover, a conductive coupling is established between the customer lead wires and the telephone network conductors 164, by way of a path which includes terminals 123, wires 132, RJ11 plug 152, conductor 162, 645-type plug 160, and wires 164.

According to an aspect of the present invention, a latching means is positioned only between the first and second holes 124, for maintaining the upper portion 126 of the housing 119 in the closed position. In the exemplary embodiment, the latching means is a single latch 129. One of ordinary skill recognizes that, alternatively, multiple latches positioned between the holes 124 could also be used, with a corresponding increase in the width of the connector. Further, the phrase, "only between the first and second holes" is expressly defined herein to mean that, in the horizontal (X) direction shown in FIG. 1, the latching means 129 lies within the horizontal range $\alpha$. The phrase "only between the first and second holes" is not intended to restrict the position of the latching means in the vertical (Z) direction of FIG. 1.

Because the latch 129 is between the holes 124, it is possible to position terminals 123 further apart in the horizontal (X) direction of FIG. 1. It is desirable to separate terminals 123 for at least two reasons: (1) increasing the space between terminals 123 reduces parasitic (i.e., capacitive or inductive) couplings between the two terminals; and (2) given a desired minimum distance between the two terminals 123, (and assuming no separation in the vertical (Z) direction of FIG. 1) increasing the separation in the (X) direction reduces the amount of separation in the (Y) direction of FIGS. 2A–2C necessary to provide the desired total separation.

In a preferred embodiment, there is sufficient separation in the (X) direction so that no separation in the (Y) direction is necessary to provide the desired total separation (and thereby limit the parasitic couplings). Thus, as shown in FIGS. 2A–2C, the first and second terminals 123 are positioned in a single (Y=constant) plane.

Because no separation in the (Y) direction is required, the depth of the connector 120 in the Y direction can be reduced below that of known connectors in the prior art. Because of the reduced depth in the (Y) direction, the total weight of the material required may be reduced.

In contrast, in a conventional connector having a pair of latches, with a pair of lead wire receiving holes between the two latches, the terminals were adjacent to one another in the (X) direction, requiring significant separation in the (Y) direction to achieve a desired total separation between the terminals. As a result, the overall depth of the conventional connector was greater, increasing the weight of the connector.

The exemplary terminals 123 have their bottom portions 123*a* aligned below the lead wire receiving holes 124. One of ordinary skill recognizes that the capacitive couplings between the terminals may be further reduced by using terminals (not shown) in which the bottom portions of the terminals are offset from the top portions of the terminals, so that the bottom portions of the terminals are spaced further apart than the distance $\alpha$ between the lead wire receiving holes.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A connector, comprising:

first and second terminals, each terminal having an upper portion including a pair of upwardly projecting members, the first and second terminals each having a lower portion connectable to respective first and second wires; and a housing, comprising:

a lower portion having first and second openings in which the respective first and second terminals are seated, an upper portion pivotably attached to the lower portion of the housing, the upper portion of the housing including first and second holes, the upper portion of the housing having an open position for insertion of respective third and fourth wires in the first and second holes, respectively, and a closed position for connecting the upwardly projecting members of the first and second terminals to the third and fourth wires, respectively, and a single latch, positioned between the first and second holes, for maintaining the upper portion of the housing in the closed position.

2. A connector according to claim 1, wherein the latch is made of an insulating material.

3. A connector according to claim 1, wherein the housing is formed of a single piece of material.

4. A connector according to claim 3, wherein the lower and upper portions of the housing are connected by a living hinge.

5. A connector according to claim 1, wherein the latch is formed of an insulating material.

6. A connector according to claim 1, wherein the first and second terminals are positioned in a single plane.

7. The connector of claim 1, wherein the latch is located at approximately the same height as the first and second holes.

8. An insulation displacement connector, comprising:

first and second terminals, each terminal having an upper portion including a pair of upwardly projecting cutting tangs, the first and second terminals each having a lower portion connectable to respective first and second wires; and a housing formed of a single piece of insulating material, comprising:

a lower portion having first and second openings in which the respective first and second terminals are seated, so that the first and second terminals lie in a single plane, an upper portion pivotably attached to the lower portion of the housing by a living hinge, the upper portion of the housing including first and second holes, the upper portion of the housing having an open position for insertion of respective third and fourth wires in the first and second holes, respectively, and a closed position for connecting the cutting tangs of the first and second terminals to the third and fourth wires, respectively, and a single latch, positioned between the first and second holes, for maintaining the upper portion of the housing in the closed position.

9. The connector or claim 8, wherein the latch is located at approximately the same height as the first and second holes.

10. An insulation displacement connector, comprising:

first and second terminals, each terminal having an upper portion including means for displacing sufficient insulation from a wire to form an electrical connection therewith, the first and second terminals each having a lower portion connectable to respective first and second wires; and a housing, comprising:

a lower portion having first and second openings in which the respective first and second terminals are seated, an upper portion pivotably attached to the lower portion of the housing, the upper portion of the housing including first and second holes, the upper portion of the housing having an open position for insertion of respective third and fourth wires in the first and second holes, respectively, and a closed position for connecting the insulation displacing means of the first and second terminals to the third and fourth wires, respectively, and latching means, positioned only between the first and second holes, for maintaining the upper portion of the housing in the closed position.

11. The connector of claim 10, wherein the latching means is located at approximately the same height as the first and second holes.

12. A bridge assembly, comprising:

(a) a connector comprising:

first and second terminals, each terminal having an upper portion including a pair of upwardly projecting members, the first and second terminals each having a lower portion connectable to respective first and second wires; and a housing, comprising:

a lower portion having first and second openings in which the respective first and second terminals are seated, an upper portion pivotably attached to the lower portion of the housing, the upper portion of the housing including first and second holes, the upper portion of the housing having an open position for insertion of respective third and fourth wires in the first and second holes, respectively, and a closed position for connecting the upwardly projecting members of the first and second terminals to the third and fourth wires, respectively, and a single latch, positioned between the first and second holes, for maintaining the upper portion of the housing in the closed position;

(b) a plug connected to respective ends of the first and second wires opposite the first and second terminals; and (c) a base on which the connector is mounted, the base having a jack therein, the jack being capable of receiving the plug for forming an electrical connection therewith.

13. The bridge assembly of claim 12, wherein the jack is an RJ11 jack.

14. The bridge assembly of claim 12, wherein the base has an additional jack for receiving an additional plug which is connected to an external network, said additional jack being positioned so that the plug is electrically connected to the additional plug when the plug is inserted in the jack and the additional plug is inserted in the additional jack.

15. The bridge assembly of claim 12, wherein the base has an opening, the opening having a first portion extending downward from a top of the base, and a second portion extending upward from a bottom of the base, the first and second portions being offset from each other, so that the opening provides stress relief when the first and second wires are positioned in the opening.

16. The connector of claim 12, wherein the latch is located at approximately the same height as the first and second holes.

* * * * *